United States Patent [19]

Deffeyes

[11] 4,036,360

[45] July 19, 1977

[54] PACKAGE HAVING DESSICANT COMPOSITION

[75] Inventor: Robert J. Deffeyes, Arlington, Tex.

[73] Assignee: Graham Magnetics Incorporated, Graham, Tex.

[21] Appl. No.: 631,361

[22] Filed: Nov. 12, 1975

[51] Int. Cl.[2] ..... B65D 81/26; F17C 11/00; B32B 5/16; C09K 3/00

[52] U.S. Cl. ..... 206/204; 252/194; 260/37 N; 428/35; 428/308; 428/309; 428/330; 428/331; 428/425; 428/913

[58] Field of Search ..... 252/194; 260/37 N; 428/308, 309, 330, 331, 913, 35, 425; 206/204

[56] References Cited

U.S. PATENT DOCUMENTS

| | | | |
|---|---|---|---|
| 3,301,788 | 1/1967 | Cummings et al. | 252/194 |
| 3,326,810 | 6/1967 | Dolan et al. | 428/76 |
| 3,622,526 | 11/1971 | Zorn et al. | 260/37 N |
| 3,642,044 | 2/1972 | Fertig et al. | 260/37 N |
| 3,704,806 | 12/1972 | Plachenov | 260/38 |
| 3,764,365 | 10/1973 | Duncan et al. | 260/37 N |
| 3,833,406 | 9/1974 | White | 252/194 |
| 3,874,904 | 4/1975 | Orsini et al. | 260/37 N |

*Primary Examiner*—George F. Lesmes
*Assistant Examiner*—William R. Dixon, Jr.
*Attorney, Agent, or Firm*—Robert A. Cesari; John F. McKenna; Andrew F. Kehoe

[57] ABSTRACT

A package comprising a dessicant material consisting essentially of 1 a dessicant and 2 tough, film-forming, resin having a high moisture vapor transmission rate. A prepolymerized polyurethane is particularly useful. The material is of particular value as a package insert - e.g. with film or cameras or as a coating material which can be utilized on equipment to be protected or, most advantageously, on the interior walls of packaging boxes and the like.

10 Claims, 3 Drawing Figures

PACKAGE HAVING DESSICANT COMPOSITION

BACKGROUND OF THE INVENTION

This invention relates to packages comprising a novel dessicant composition.

Most people are familiar with the small bags or capsules of dessicant, often of silica gel or moisture absorbing inorganic salts, which are used in packages of pharmaceuticals, precision instruments such as cameras, or other items which require protection from moisture.

It is desirable to provide a less expensive or more convenient means for achieving the protection of the contents of these packages. Moreover, it is desirable to provide a type of dessicant that can be tailored not to respond to rapid, temporary increases in moisture handling and before placement in the package. Such response unnecessarily uses up the water-retaining capacity of the dessicant or, more realistically, requires that it be given special handling before dispensing into the package to be protected.

Attention has been paid to these problems in the prior art. U.S. Pat. No. 3,704,806 discloses a composition comprising zeolite dessicant held in an adhesive bond with an epoxy resin or phenol-formaldehyde resins. Such a composition is disclosed to be useful as a film or in coating form. A polyvinyl butyral is used to increase the moisture permeability of the resins.

Other inventors have suggested improved means for using of particulate dessicants. U.S. Pat. No. 3,326,810 discloses a bag which is formed of a microporous polyurethane bonding a nylon mesh to form a sheet material and sealing the sheet material to form a sheet material and sealing the sheet material to form a nondusting bag of dessicant. The pore size of the polyurethane is given as 40–60 microns. It is through the pores that moisture vapor reaches the dessicant.

In U.S. Pat. No. 3,301,788, Cummings discloses a dessicant pellet formed of dessicant powder bonded together within a polyvinyl alcohol matrix. The resulting product is a relatively dust-free dessicant pellet.

None of the above attempts to improve the convenience and efficiency of dessicant use provide a broadly-acceptable solution to dessicant users. The constructions tend to be too expensive, and the dessicant cannot be loaded into the suggested binder materials at high loadings without an excessively fragile structure being created. Moreover, most of the binders are either susceptible to degradation by moisture or other chemicals or insufficient moisture-vapor-transmission characteristics.

SUMMARY OF THE INVENTION

Therefore, it is an object of the present invention to provide an improved dessicant composition, one which can contain a relatively large quantity of dessicant while, at the same time, having improved mechanical strength.

Another object of the invention is to provide a dessicant composition suitably adhesive for coating applications.

Still another object of the invention is to provide an improved dessicant material and processes and packages utilizing the same, wherein mechanical integrity, moisture-absorbing capacity, and simple construction are all combined.

Another object is to provide a dessicant (and packages containing the same) that can be handled normally, even in humid atmospheres, for short periods of time, as will be encountered in manufacturing and packaging operations, without excessive loss of its dessicating capacity.

Other objects of the invention will be obvious to those skilled in the art on reading the instant invention.

The above objects have been achieved by the discovery that certain organic resins have a combination of moisture vapor transmission (MVT) characteristics, of mechanical strength, and of dessicant solid-binding ability that they can serve to provide all of the requisite attributes required of a substantially improved dessicant composition. Moreover, these compositions are chemically inert and are conveniently compounded. Thus, they are most unlikely to cause any contamination problem and may be manufactured cheaply. Moreover, they have excellent adhesive characteristics where such characteristics are applied.

The most advantageous of these resins are prepolymerized polyurethane resins. Other polyurethanes can be used, but they lack the desired toughness of the prepolymerized materials.

Among the dessicants which can be used are alumina, bauxite, anhydrous calcium sulfate, water-absorbing clays, silica gel, zeolite and any of the other moisture-absorbing materials known to the art. Various moisture sensitive indicators, e.g. cobalt chloride which would change color to indicate it has been "used up". Some commercial dessicants already have such an indicator compounded therewith, e.g. a so-called "Tell-Tale" Blue Silica gel sold by W. R. Grace.

The prepolymerized polyurethanes have excellent film-forming ability. Consequently, they can be used to effectively bind relatively large quantities of dessicants. At least about 20% by volume of dessicant will be present in the composition and articles of the invention. However, 60% or more by volume is preferred and up to 80% or more is advantageous when relatively large particles of dessicant are used.

The reported moisture-vapor transmission characteristics of these film-forming polyurethanes are excellent. Typical values of polyurethanes range from 40 to 75 grams per 100 square inches per 24 hour at 37.8° C using standard ASTM MVT-measuring procedures. However, the prepolymerized polyurethanes, solvent cast have been found to have values as high as 100 grams per 100 square inches per 24 hours when measured at thicknesses of 2 to 6 mils when measured at 30° C. This valve may reflect some microporosity, but such porosity although not necessary is advantageous.

This combination of generally unrelated properties combine to provide an extraordinary binder for use in dessicant formulations and as a dessicant binder. However, the advantage suggested by the MVT data and the film-forming capability is still further enhanced by excellent mechanical properties and chemical inertness of the prepolymerized polyurethanes.

In selecting a polyurethane for a particular application, attention should be given to whether the application requires, adhesion of the dessicant composition, requires a melt formation of the compositions, or requires optimum strength and film-forming of the composition to achieve a high loading of dessicant. The prepolymerized polyurethanes sold by B. F. Goodrich Chemical Company under the trade name Estane are excellent binders for use in the invention. Best strength can be obtained with such materials as those sold under the Estane 5707 F-1 and Estane 5714 F-1. Estane 5701 has a conveniently low melting point for melt casting and adhesion characteristics and Estanes 5703, 5702 and 5711 are also typical of useful polyurethanes. It should be understood that conventional polyurethanes which are formed in place, e.g. by the reaction of polyols and isocyoanates are entirely acceptable for applications where strength is not required. An example of such an application would be molded dessicant plugs in the caps and bottoms of small film cans.

Other organic resins can be mixed with the polyurethanes but should not exceed about 50% of the total weight of resin binder. Phenoxy resins of the type sold under the trade designation PKHH by Union Carbide Corp. are particularly useful in this respect. Also, other adjuvants may be used to plasticize the binder, stabilize it against heat, oxygen or radiation, and perform such other functions as a well-known in the inorganic-resin compounding art.

The prepolymerized polyurethane will, most advantageously, have minimum Tensile strengths of 1000 psi and elongation values of 200%. The best materials have tensile strengths of about 6000 psi and elongations of 100% or more. These, of course, are basic properties which are reduced by addition of dessicant.

It is to be emphasized that in most embodiments of the invention, the dessicant is carried, for the most part, within a matrix formed by the binder. However, in some other embodiments a large part of the dessicant is carried on the resin surface. Such other embodiments require special handling, i.e., should not be exposed to high humidity environment even for short periods of time before use or the dessicating potential will be markedly reduced.

ILLUSTRATIVE EXAMPLES OF THE INVENTION

In order to point out more fully the nature of the present invention, the following specific examples are given as illustrative embodiments of the present process and products produced thereby.

IN THE DRAWINGS

FIG. 1 is a schematic diagram of the crossection of a tape 10 comprising coating 12 formulated according to the invention, in this case mounted on a mylar-support sheet 14.

EXAMPLE 1

Figure 1:
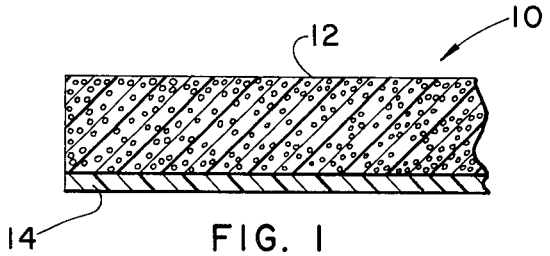
Figure 3:
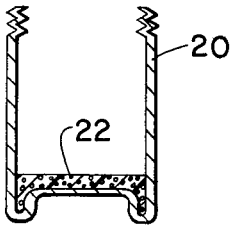
FIG. 3 is a section of a package 20, a can, showing a plug 22 of dessicant mounted in a package.
Figure 2:
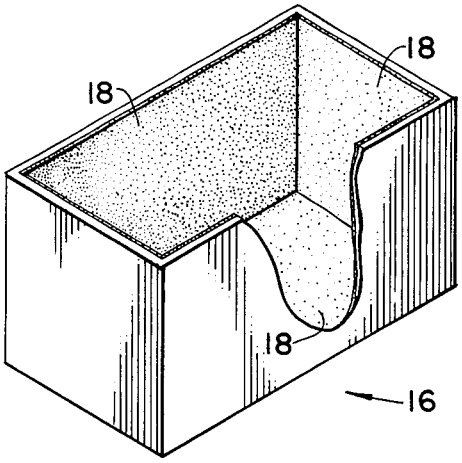
FIG. 2 is a perspective view of schematic diagram of a package 16 comprising an interior coating 18 of the dessicant composition.

A mixture is formed of a. 850 grams of tetrahydrofuran b. 150 grams of a prepolymerized polyurethane sold under the trade designation of Estane 5701.

4000 grams of a silica gel sold under the trade designation Tell Tale Blue by W. R. Grace. The silica gel passes 6–16 mesh. The mixture is coated onto a Mylar polyester film, the coating being about 0.125 inch thick. The resulting sheet is dryed in an oven at 100° C, then cut into strips and placed in small packages. The silica gel contains a moisture indicator for visually indicating when the silica gels dessicating efficiency drops below a certain point.

Among the ways in which the dessicant compositions of the invention can be used advantageously are the following:

1. Coat the composition onto a reinforcing film e.g. a polyester film strip and dry the coating at 110° C. Cut the film strip into shorter strips which can be inserted into packages. This has been described above.
2. Coat the composition onto a release paper, peel it off and cut it into strips - the binder provides the required structural integrity to form the article without a supporting film.
3. Coat the dessicant composition onto a permeable backing, e.g. paper, and adhesively bond the coating itself to the inside of a package.
4. Coat the inside of a package with the dessicant composition.
5. Place the composition into one portion of a package— i.e., in the cap or bottom of a photographic film can — and dry it to a solid.

It is to be understood that the following claims are intended to cover all of the generic and specific features of the invention herein described and all statements of the scope of the invention which might be said to fall therebetween.

What is claimed is:

1. A dessicant composition of the type adapted to absorb moisture in packing applications comprising at least 20% of a particulate dessicant material and b. as a binder therefor, an effective quantity of an organic resin comprising at least about 50% of a prepolymerized polyurethane resin having an MVT value of at least 40 grams per 24 hours per 100 in$^2$, and wherein said polyurethane has the following minimal physical characteristics:
Tensile strength — 1000 psi and
Elongation — 200%.

2. A dessicant composition as defined in claim 1 comprising at least 60% by volume of dessicant.

3. A composition as defined in claim 2 wherein said MVT value is between 75 and 100 grams per 100 square inches.

4. A composition as defined in claim 1 wherein said elongation is at least 100% and said tensile strength is at least 6,000 psi.

5. A composition as defined in claim 1 having an MVT value of at least 50.

6. A package comprising, adherent to an interior surface thereof a dessicant composition as defined in claim 1.

7. A package comprising, loosely contained therein, a dessicant article formed of the composition defined in claim 1.

8. A dessicant sheet comprising a composition as defined in claim 1 and said composition having an MVT value of over about 50.

9. A sheet as defined in claim 8 wherein said elongation is at least 100% and said tensile strength is at least 6,000 psi.

10. A process for making a dust-free dessicant composition comprising mixing said dessicant in a prepolymerized polyurethane binder, and solidifying said binder as defined in claim 1 to form said dust-free composition.

* * * * *

UNITED STATES PATENT AND TRADEMARK OFFICE

CERTIFICATE OF CORRECTION

PATENT NO. 4,036,360

DATED July 19, 1977

INVENTOR(S) Robert J. Deffeyes

It is certified that error appears in the above-identified patent and that said Letters Patent are hereby corrected as shown below:

| | |
|---|---|
| Col. 1, lines 33-34: | delete second occurrence of "to form a sheet material and sealing the sheet material" |
| Col. 2, line 48: | change "valve" to --value-- |
| Col. 3, line 17: | change "inorganic" to --organic-- |
| Col. 3, line 58: | delete "." |
| Col. 3, line 59: | insert "c." before "4000" |
| Col. 4, line 30: | insert "a." before "at least 20%" |

Signed and Sealed this

*Eighteenth* Day of *April 1978*

[SEAL]

*Attest:*

RUTH C. MASON
*Attesting Officer*

LUTRELLE F. PARKER
*Acting Commissioner of Patents and Trademarks*